US010476183B2

(12) United States Patent
Lee

(10) Patent No.: US 10,476,183 B2
(45) Date of Patent: Nov. 12, 2019

(54) TERMINAL ASSEMBLY FOR ELECTRIC COMPRESSOR

(71) Applicant: HYUNDAI MOBIS CO., LTD., Seoul (KR)

(72) Inventor: Bit Na Lee, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 16/048,621

(22) Filed: Jul. 30, 2018

(65) Prior Publication Data

US 2019/0058269 A1 Feb. 21, 2019

(30) Foreign Application Priority Data

Aug. 18, 2017 (KR) ..... 10-2017-0104697

(51) Int. Cl.

| | |
|---|---|
| ***H01R 4/02*** | (2006.01) |
| ***H01R 9/22*** | (2006.01) |
| ***H01R 13/436*** | (2006.01) |
| ***H01R 13/506*** | (2006.01) |
| *F04B 35/04* | (2006.01) |

(52) U.S. Cl.

CPC ..... *H01R 9/223* (2013.01); *H01R 4/023* (2013.01); *H01R 4/029* (2013.01); *H01R 13/4364* (2013.01); *H01R 13/506* (2013.01); *F04B 35/04* (2013.01)

(58) Field of Classification Search

CPC ..... H01R 4/029; H01R 4/023

USPC ..... 439/707, 709

See application file for complete search history.

(56) References Cited

U.S. PATENT DOCUMENTS 7,806,712 B2 * 10/2010 Negishi ..... F04B 35/04 439/281

2014/0256196 A1 * 9/2014 Suzuki ..... H01R 13/4223 439/746

* cited by examiner

*Primary Examiner* — Abdullah A Riyami

*Assistant Examiner* — Justin M Kratt

(74) *Attorney, Agent, or Firm* — Knobbe Martens Olson & Bear LLP

(57) ABSTRACT

A terminal assembly for an electrical compressor may include: a terminal housing having an internal space divided into a plurality of spaces, and fixed to a driver; a plurality of terminal parts positioned in the terminal housing, and each having one side connected to a magnet wire and the other side to form a hole into which an electric conduction pin is inserted; and a cover part coupled to the terminal housing, and constraining the movement of the terminal part. The magnet wire may be connected to the terminal part by welding.

6 Claims, 6 Drawing Sheets

TERMINAL ASSEMBLY FOR ELECTRIC COMPRESSOR

CROSS-REFERENCES TO RELATED APPLICATIONS

The present application claims priority to Korean application number 10-2017-0104697, filed on Aug. 18, 2017, which is incorporated by reference in its entirety.

BACKGROUND OF THE INVENTION

The present invention relates to a terminal assembly for an electric compressor, and more particularly, to a terminal assembly for an electric compressor, which can stably achieve electrical connection between a controller and a driver, and improve the productivity by reducing the number of parts.

In general, an electric compressor includes a driver which generates power using a voltage supplied thereto and a compressor which compresses a refrigerant using the power received from the driver, the compressor being installed at one side of the driver.

A controller is installed at the other side of the driver, and the driver and the controller receive a voltage through a supply terminal. The supply terminal includes a terminal for transferring the voltage between the driver and the controller. When the driver uses a three-phase motor, three terminals are installed and arranged in parallel to one another.

In the conventional electric compressor, a wire member connected to the driver and a terminal for inserting an electric conduction pin are pressed and fixed to each other. In this case, since the connection state is unstable, the electric compressor is highly likely to cause an operation abnormality. Furthermore, since the number of parts to fix the terminals is increased, the number of assembling processes is inevitably increased. Therefore, there is a demand for a structure capable of solving the problem.

The related art of the present invention is disclosed in Korean Patent Registration No. 10-1749819 published on Jun. 15, 2017 and entitled "Control device for on-vehicle electric compressor".

SUMMARY OF THE INVENTION

Embodiments of the present invention are directed to a terminal assembly for an electric compressor, which can stably achieve electrical connection between a controller and a driver, and improve the productivity by reducing the number of parts.

In one embodiment, a terminal assembly for an electrical compressor may include: a terminal housing having an internal space divided into a plurality of spaces, and fixed to a driver; a plurality of terminal parts positioned in the terminal housing, and each having one side connected to a magnet wire and the other side to form a hole into which an electric conduction pin is inserted; and a cover part coupled to the terminal housing, and constraining the movement of the terminal part. The magnet wire may be connected to the terminal part by welding.

The terminal housing may include: a connection fixing part fixed to the outside of the driver; and a housing body connected to the connection fixing part, and forming the internal space divided into the same number of spaces as the number of the terminal parts.

The front of the housing body may be opened, and the housing body may have a plurality of inner partition walls installed therein.

The terminal part may include: a first terminal connected to the magnet wire; and a second terminal having a smaller diameter than the first terminal, and connected to the first terminal.

The first terminal may be electrically connected to the magnet wire, and the second terminal extended from the first terminal may be formed in a cylindrical shape.

The plurality of terminal parts may be installed in the terminal housing, and divided by the respective inner partition walls.

The cover part may include: a cover body opening/closing the entrance of the housing body; and a first lock part extended from either side of the cover body, and locked to a first protrusion formed at the outside of the housing body.

The cover part may further include a second lock part extended from the bottom of the cover body and locked to a second protrusion formed at the bottom of the housing body.

The cover part may further include protrusion-shaped guide support parts extended from the cover body and constraining the movement of the second terminal while being in contact with the side surface of the second terminal.

The terminal housing may be formed as a single member.

DESCRIPTION OF SPECIFIC EMBODIMENTS

Hereafter, a terminal assembly for an electric compressor in accordance with an embodiment of the present invention will be described in detail with reference to the accompanying drawings. It should be noted that the drawings are not to precise scale and may be exaggerated in thickness of lines or sizes of components for descriptive convenience and clarity only.

Furthermore, the terms as used herein are defined by taking functions of the invention into account and can be changed according to the custom or intention of users or operators. Therefore, definition of the terms should be made according to the overall disclosures set forth herein.

Figure 1:
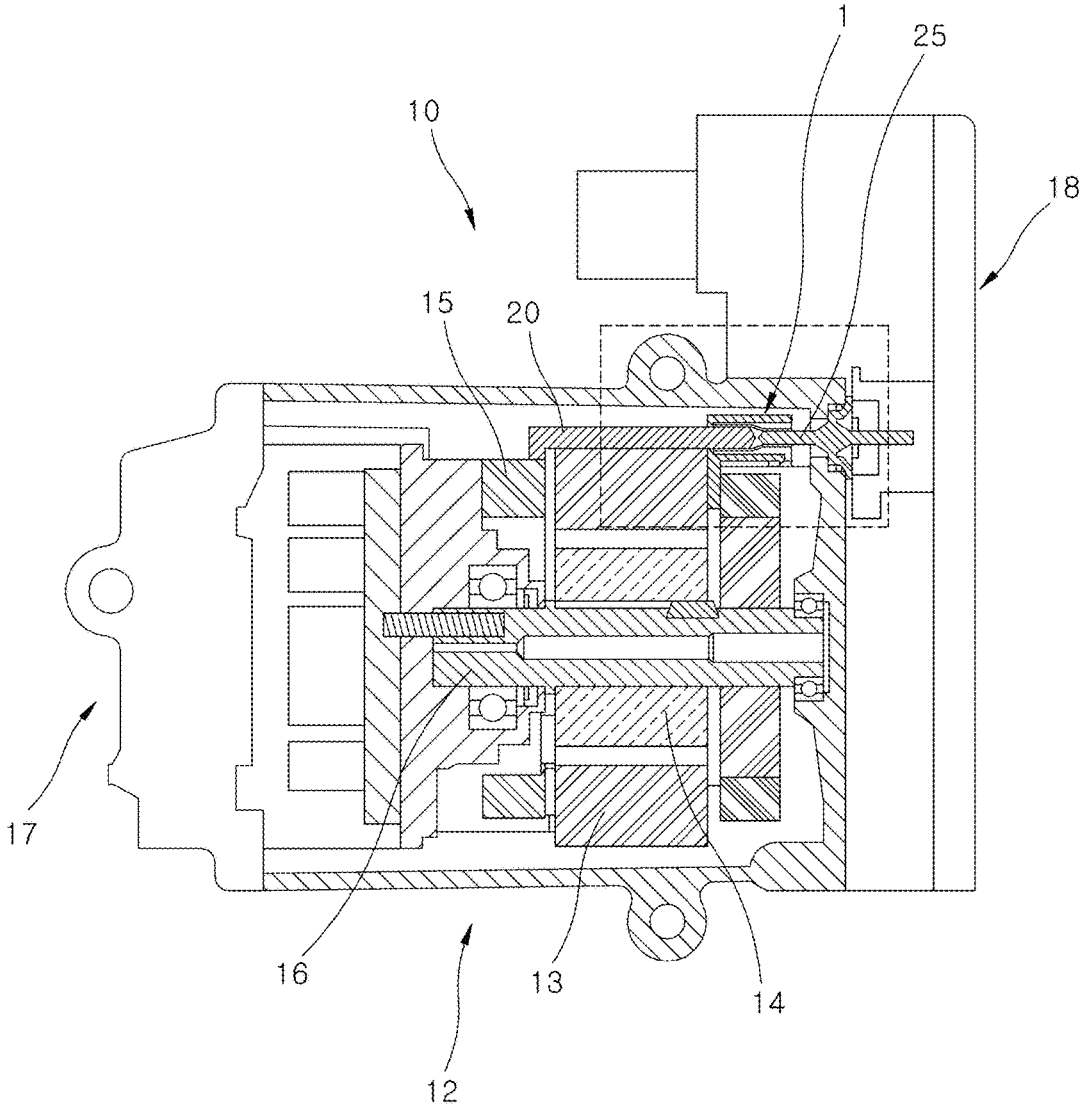
FIG. 1 is a cross-sectional view schematically illustrating that a terminal assembly for an electric compressor in accordance with an embodiment of the present invention is installed.
Figure 2:
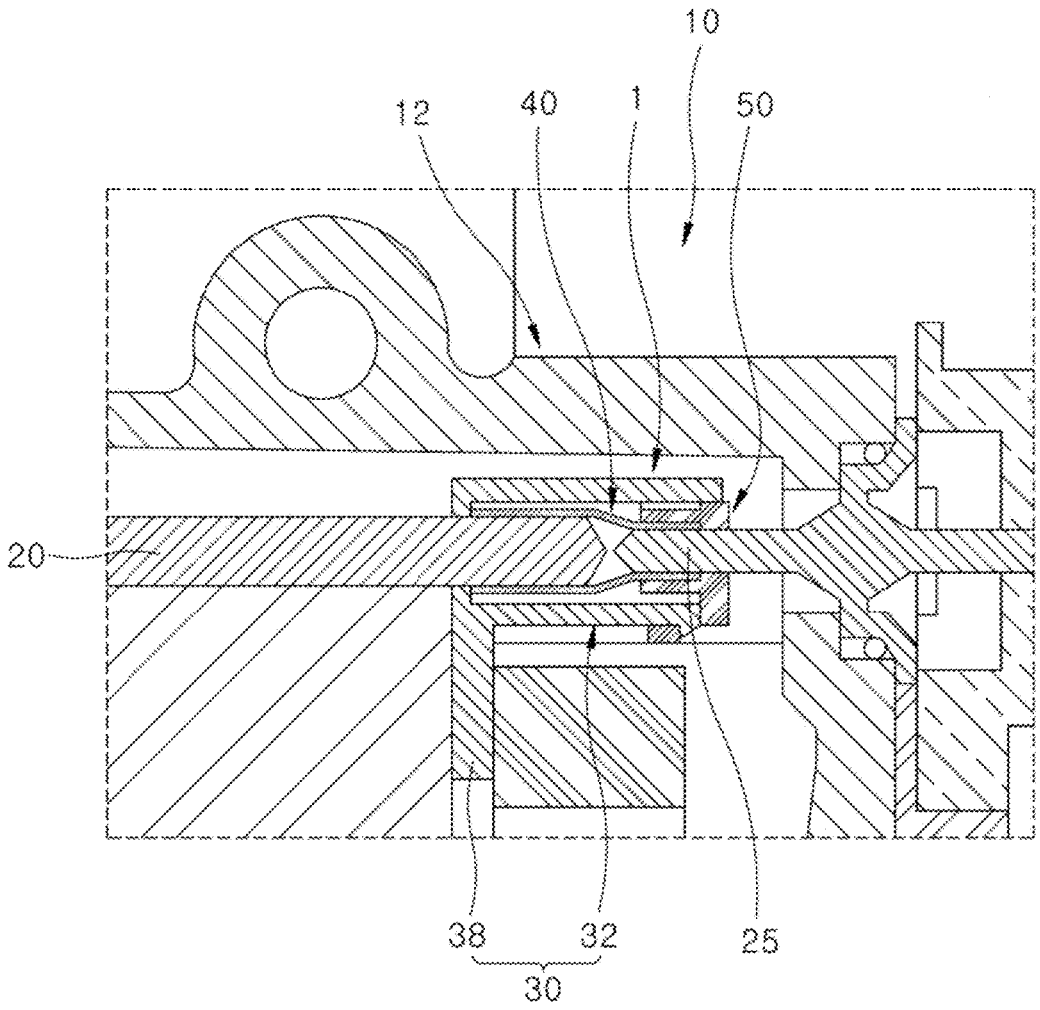
FIG. 2 is a cross-sectional view schematically illustrating that an electric conduction pin is connected to the terminal assembly for an electric compressor in accordance with the embodiment of the present invention.
Figure 3:
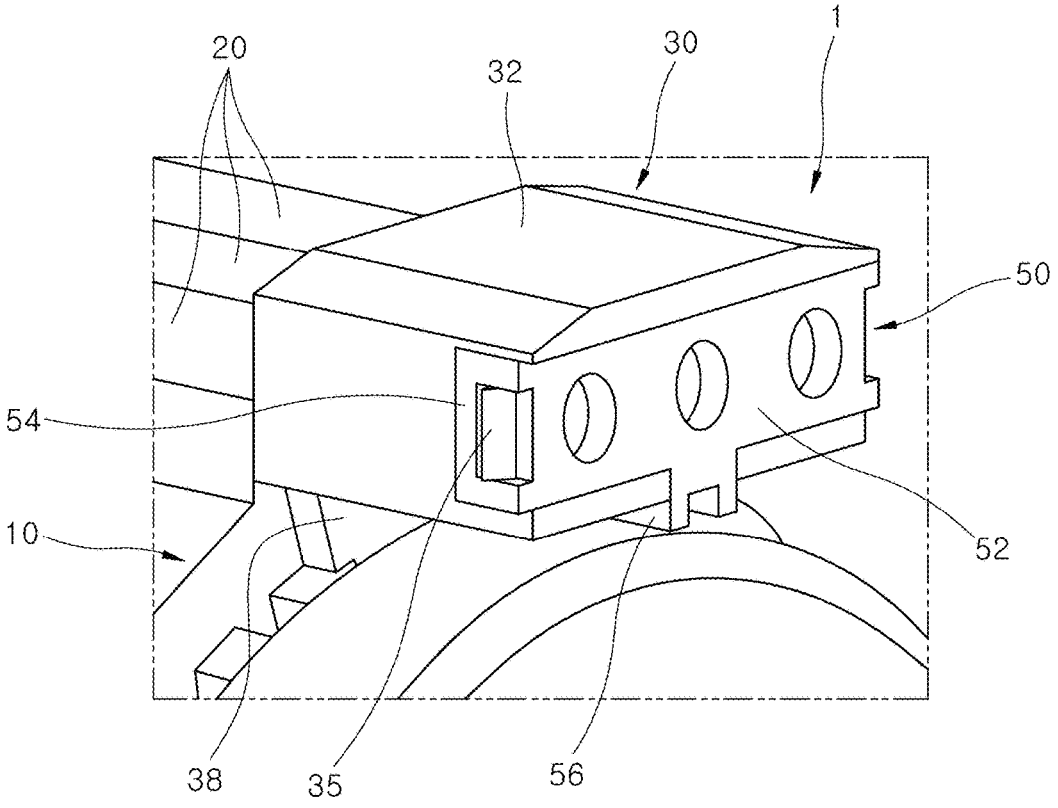
FIG. 3 is a perspective view illustrating the exterior of the terminal assembly for an electric compressor in accordance with the embodiment of the present invention.
Figure 4:
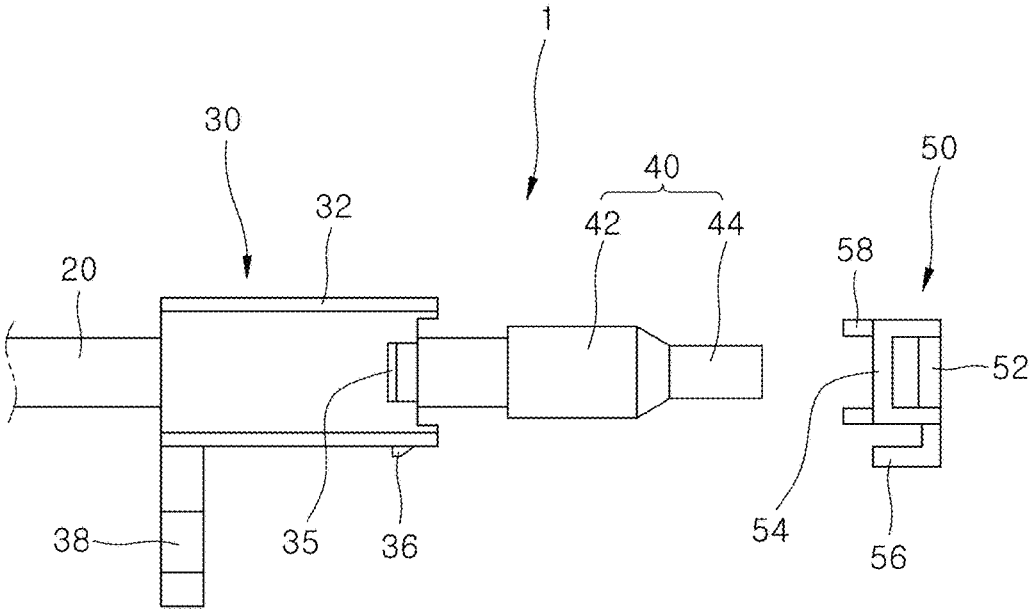
FIG. 4 is an exploded view illustrating main components of the terminal assembly for an electric compressor in accordance with the embodiment of the present invention.
Figure 5:
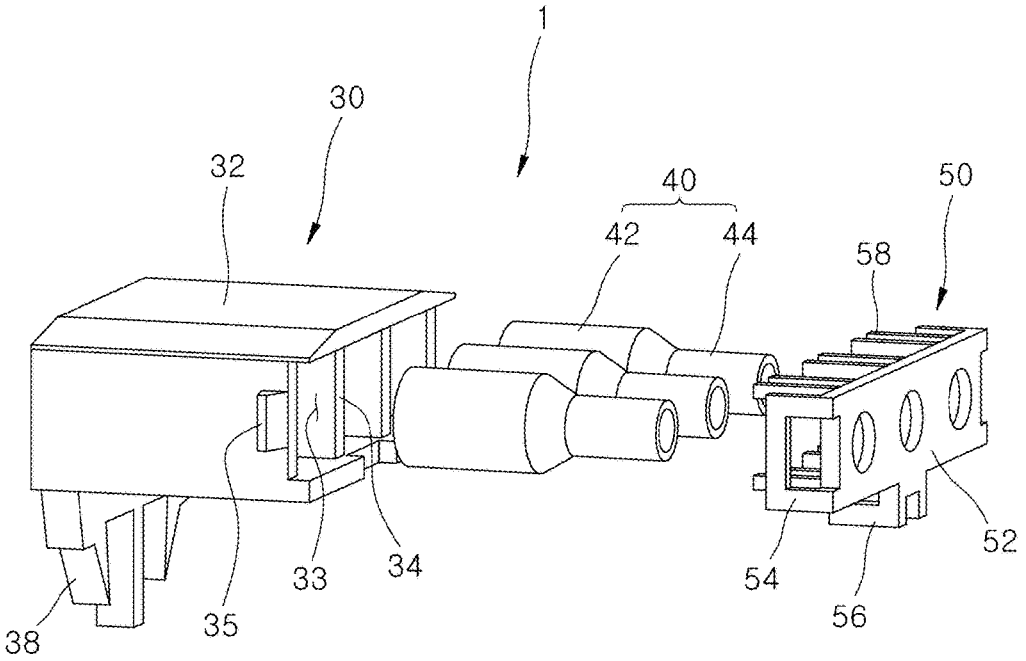
FIG. 5 is an exploded perspective view illustrating the main components of the terminal assembly for an electric compressor in accordance with the embodiment of the present invention.
Figure 6:
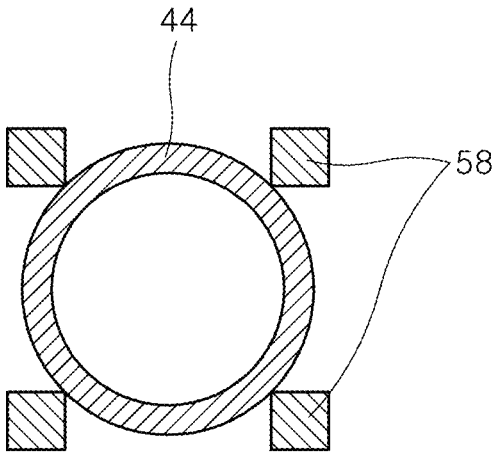
FIG. 6 is a cross-sectional view illustrating that a guide support part in accordance with the embodiment of the present invention supports a second terminal.

FIG. 1 is a cross-sectional view schematically illustrating that a terminal assembly for an electric compressor in accordance with an embodiment of the present invention is installed, FIG. 2 is a cross-sectional view schematically illustrating that an electric conduction pin is connected to the terminal assembly for an electric compressor in accordance with the embodiment of the present invention, FIG. 3 is a perspective view illustrating the exterior of the terminal assembly for an electric compressor in accordance with the embodiment of the present invention, FIG. 4 is an exploded view illustrating main components of the terminal assembly for an electric compressor in accordance with the embodiment of the present invention, FIG. 5 is an exploded perspective view illustrating the main components of the terminal assembly for an electric compressor in accordance with the embodiment of the present invention, and FIG. 6 is a cross-sectional view illustrating that a guide support part in accordance with the embodiment of the present invention supports a second terminal.

As illustrated in FIGS. 1 to 3, the terminal assembly 1 for an electric compressor in accordance with the embodiment of the present invention may include a terminal housing 30, a terminal part 40 and a cover part 50. The terminal housing 30 may be fixed to a driver 12, and have an internal space 33 divided into a plurality of spaces. The terminal part 40 may be installed in the terminal housing 30, and have one side connected to a magnet wire 20 and the other side to form a hole through which an electric conduction pin 25 is inserted. The cover part 50 may be coupled to the terminal housing 30, and constrain the movement of the terminal part 40. The magnet wire 20 may be connected to the terminal part 40 by welding.

The electric compressor 10 may be formed in various shapes as long as the electric compressor 10 can compress a refrigerant and discharge the compressed refrigerant. The electric compressor 10 in accordance with the embodiment of the present invention may include the driver 12, a compressor 17 and a controller 18.

The driver 12 may include a stator 13, a rotor 14, a coil member 15 and a rotating shaft member 16. The stator 13 may be installed in the case of the driver 12, and the magnetic property of the stator 13 may be changed through the coil member 15 connected to the stator 13. The rotating shaft member 16 may be rotatably installed in the stator 13, and the rotor 14 may be fixed to the rotating shaft member 16. Therefore, the rotor 14 and the rotating shaft member 16 may be rotated together.

The rotation power generated by the driver 12 may be transferred to the compressor 17 installed successively to the driver 12, and compress the refrigerant. The controller 18 including an electrical circuit may also be installed successively to the driver 12, and generate a control signal to operate the driver 12.

The magnet wire 20 connected to the coil member 15 may be inserted into the terminal housing 30 and connected to the terminal part 40. Since the electric conduction pin 25 connected to the controller 18 is connected to the terminal part 40 through the cover part 50, a voltage may be supplied to the driver 12 through the controller 18. The magnet wire 20 may be modified in various manners as long as the magnet wire 20 can electrically connected to the coil member 15 of the driver 12. The electric conduction pin 25 may be electrically connected to the controller 18. Furthermore, the electric conduction pin 25 may be electrically connected to the magnet wire 20 through the terminal part 40, in order to operate the driver 12. Since the magnet wire 20 is connected to the terminal part 40 by welding, the magnet wire 20 and the terminal part 40 may be reliably connected to each other.

As illustrated in FIGS. 3 to 5, the terminal housing 30 may be fixed to the driver 12, and have the internal space 33 divided into a plurality of spaces. The terminal housing 30 in accordance with the present embodiment may include a housing body 32 and a connection fixing part 38.

The housing body 32 may include the internal space 33, a plurality of internal partition walls 34 and first and second protrusions 35 and 36. The housing body 32 in accordance with the present embodiment may be connected to the connection fixing part 38, and form the internal space 33 divided into an equal number of spaces to the number of terminal parts 40. The front of the housing body 32 may be opened, and the plurality of internal partition walls 34 may be installed in the housing body 32. The internal partition walls 34 may divide the internal space 33 into the plurality of internal spaces in the housing body 32, and the terminal parts 40 connected to the magnet wire 20 may be installed in the respective internal spaces 33. The first protrusion 35 may be formed at both sides of the housing body 32, and the second protrusion 36 may be formed at the bottom of the housing body 32.

The connection fixing part 38 may be formed in a protrusion shape which is inserted and fixed to the outside of the driver 12, and connected to one side of the housing body 32.

The terminal part 40 may be positioned in the terminal housing 30, and include various types of connectors, as long as one side of the terminal part 40 is connected to the magnet wire 20 and the other side thereof forms a hole into which the electric conduction pin 25 is inserted. The terminal part 40 in accordance with the embodiment of the present invention may include a first terminal 42 connected to the magnet wire 20 and a second terminal 44 connected to the first terminal 42 and having a smaller diameter than the first terminal 42.

The first terminal 42 may be electrically connected to the magnet wire 20, and the second terminal 44 extended from the first terminal 42 may be formed in a cylindrical shape. The plurality of terminal parts 40 may be installed in the terminal housing 30, and divided by the respective internal partition walls 34.

As illustrated in FIGS. 4 to 6, the cover part 50 may be coupled to the front of the terminal housing 30, and constrain the movement of the terminal part 40 installed in the terminal housing 30. The cover part 50 in accordance with the present embodiment may include a cover body 52, a first lock part 54, a second lock part 56 and a guide support part 58.

The cover body 52 may be formed in a plate shape to open/close the entrance of the housing body 32, and have a plurality of holes through which the electric conduction pins 25 are moved.

The first lock part 54 may be formed in a hook shape which is extended from either side of the cover body 52 and locked to the first protrusion 35 formed outside the housing body 32. The second lock part 56 may be formed in a hook shape which is extended from the bottom of the cover body 52 and locked to the second protrusion 36 formed at the bottom of the housing body 32.

The guide support part 58 may be formed in a protrusion shape which is extended from the cover body 52 and constrains the movement of the second terminal 44 while being in contact with the side surface of the second terminal 44. In the present embodiment, two guide support parts 58 may be installed at both sides of the top of the second terminal 44, and two guide support parts 58 may be installed at both sides of the bottom of the second terminal 44. Since the guide support parts 58 are brought in contact with the outside of the second terminal 44, the guide support parts 58 may constrain the movement of the second terminal 44. Therefore, a deformation of the second terminal 44 can be prevented when the electric conduction pin 25 is coupled to or separated from the second terminal 44.

Hereafter, the operation state of the terminal assembly 1 for an electrical compressor in accordance with the embodiment of the present invention will be described in detail with reference to the accompanying drawings.

The electrical connection between the driver 12 and the controller 18 of the electric compressor 10 may be achieved through the connection between the electric conduction pin 25 connected to the controller 18 and the terminal part 40 connected to the driver 12. At this time, since the terminal housing 30 to support the terminal part 40 is implemented as a single member, the material cost and assembly property can be improved.

Since the magnet wire 20 and the terminal part 40 are connected through welding, a separate housing for fixing the magnet wire 20 does not need to be installed. Thus, the terminal housing 30 can be formed as a single member.

Since the plurality of terminal parts 40 are mounted in the respective internal spaces 33 installed in the housing body 32, short circuits of the terminal parts 40 can be prevented. Furthermore, since the electric conduction pin 25 is inserted into the second terminal 44 through the hole formed in the cover part 50, the magnet wire 20 may be electrically connected through the terminal part 40.

In accordance with the embodiment of the present invention, since the terminal part 40 and the magnet wire 20 are fixed through welding, the electrical connection between the controller 18 and the driver 12 can be stably achieved to improve the operation reliability. Furthermore, since the terminal housing 30 is formed as one body, the number of parts can be reduced, which makes it possible to shorten the assembling time while improving the productivity.

Although preferred embodiments of the invention have been disclosed for illustrative purposes, those skilled in the art will appreciate that various modifications, additions and substitutions are possible, without departing from the scope and spirit of the invention as defined in the accompanying claims.

What is claimed is:

1. A terminal assembly for an electrical compressor, comprising:

a terminal housing having an internal space divided into a plurality of spaces, and fixed to a driver that is configured to generate a rotational power for the electrical compressor;

a plurality of terminal parts positioned in the terminal housing, and each having one side connected to a magnet wire and the other side to form a hole into which an electric conduction pin is inserted; and a cover part coupled to the terminal housing, and constraining the movement of the terminal part, wherein the magnet wire is connected to the terminal part by welding, wherein the terminal housing comprises:

a connection fixing part fixed to the driver; and a housing body connected to the connection fixing part, and forming the internal space divided into the same number of spaces as the number of the terminal parts, wherein the terminal part comprises:

a first terminal connected to the magnet wire; and a second terminal having a smaller diameter than the first terminal, and connected to the first terminal, wherein the cover part comprises:

a cover body opening/closing the entrance of the housing body;

a first lock part extended from either side of the cover body, and locked to a first protrusion formed at the outside of the housing body; and a second lock part extended from the bottom of the cover body and locked to a second protrusion formed at the bottom of the housing body.

2. The terminal assembly of claim 1, wherein the front of the housing body is opened, and the housing body has a plurality of inner partition walls installed therein.

3. The terminal assembly of claim 1, wherein the first terminal is electrically connected to the magnet wire, and the second terminal extended from the first terminal is formed in a cylindrical shape.

4. The terminal assembly of claim 3, wherein the plurality of terminal parts are installed in the terminal housing, and divided by the respective plurality of inner partition walls.

5. The terminal assembly of claim 1, wherein the cover part further comprises protrusion-shaped guide support parts extended from the cover body and constraining the movement of the second terminal while being in contact with the side surface of the second terminal.

6. The terminal assembly of claim 1, wherein the terminal housing is formed as a single member.

* * * * *